US005909176A

United States Patent [19]

Schrott et al.

[11] Patent Number: 5,909,176

[45] Date of Patent: Jun. 1, 1999

[54] ANTI-THEFT AND IDENTIFICATION DEVICES FOR CONCEALING IN ARTICLES

[75] Inventors: Alejandro Gabriel Schrott; Robert Jacob von Gutfeld, both of New York; Richard Joseph Gambino, Stony Brook, all of N.Y.

[73] Assignee: Intermec IP Corporation, Beverly Hills, Calif.

[21] Appl. No.: 08/935,989

[22] Filed: Sep. 23, 1997

[51] Int. Cl.[6] ..... G08B 13/14

[52] U.S. Cl. ..... 340/572.1; 340/572.6; 340/551

[58] Field of Search ..... 340/551, 572, 340/572.1, 572.3, 572.6, 572.4, 572.5

[56] References Cited

U.S. PATENT DOCUMENTS 5,736,929 4/1998 Schrott et al. ..... 340/572

*Primary Examiner*—Nina Tong
*Attorney, Agent, or Firm*—McGinn & Gibb,P.C.

[57] ABSTRACT

A tag for concealing in an object for providing antitheft protection and identification, and a system for incorporating the tag, include in one embodiment a magnetic antitheft element, and an identification code including a pattern of first and second segments of wires of high thermal conductivity situated at right angles to the antitheft element and in intimate thermal contact with the antitheft element. The length of the first segments is longer than the length of the second segments.

33 Claims, 9 Drawing Sheets

ANTI-THEFT AND IDENTIFICATION DEVICES FOR CONCEALING IN ARTICLES

CROSS-REFERENCE

The inventions disclosed and claimed herein are related to the inventions disclosed and claimed in applications Ser. Nos. 08/660,261 and 08/660,249 which are assigned to the same assignee as the instant application.

FIELD OF THE INVENTION

The present invention generally relates to identification tags or markers for attachment to an article of interest, and more particularly to a special type of magnetic tag that serves both as an identifier of the article to which it is attached and as an antitheft device.

BACKGROUND OF THE INVENTION

Systems are known for the prevention of theft of articles, e.g., books from libraries and products from stores, which generally comprise a marker element attached to the article and instruments adapted to sense a signal produced by the marker upon its passage through an interrogation zone. Typically the marker is a magnetic wire or strip and the interrogation zone is provided by transmitter antenna coils which generate an alternating magnetic interrogation field in the zone. The marker is driven into and out of saturation which disturbs the alternating magnetic interrogation field and produces alternating magnetic fields at frequencies which are harmonics of the alternating magnetic interrogation field. The harmonics are detected by receiver antenna coils, which are frequently housed in the same structure as the transmitter coils, which in turn are processed by electronic processing means to produce alarm signals.

On a more sophisticated level, for retail tagging, tagging used in the road/air-freight package industry, and pallet tagging in manufacturing processes, a tag (also known as an "identification tag", "marker" or "label") is useful for identifying a product or article in detail. Such tags include bar code labels and radio frequency tags based on silicon memory and logic circuits (also known as RFID tags). By providing the tag with a sufficient number of bits and interrogating the tag, the tag can provide information such as what the product is, when it was manufactured, its price, and whether the product has been properly passed through a check-out counter or kiosk. Tags can also be used to identify a variety of other animate and inanimate objects too numerous to mention. Identifying a product via an RFID tag may hasten a new type of checkout system for the retail industry giving rise to a so-called "no-wait checkout".

The present technology used for magnetic tags which are widely used for anti-theft purposes has several drawbacks when extended to multibit capabilities including that relatively large sized markers result. In addition, there are problems due to the method of the tag's operation which prevents them from being solidly embedded. An example of a large multi-bit marker is the tag of Pettigrew et al., U.S. Pat. No. 4,940,966. Pettigrew et al. describe a tag having a limited number of bits which includes a plurality of soft magnetic strips mounted on a substrate, biased by adjacent strips of hard magnetic material. Typical spacing between strips is on the order of one centimeter with some strip lengths greater than 4 cm. Here, each element or strip defining a bit must have dimensions that differ from one another in order to give them a distinct characteristic, here being a unique hysteresis curve.

The magnetic multibit tag described by Dames and Hyde (U.S. Pat. No. 5,420,569) uses magneto-mechanical coupling to cause resonances characterized by planar dimensional changes and enhanced magnetization of the strip elements. This tag is both large and has the disadvantage that the strip needs to be free-standing in order to resonate and therefore cannot be embedded.

The systems described above all have the capability of being interrogated remotely. In addition, there are means for storing many bits of information per unit area using magnetic stripes on items like credit cards. However, this type of storage device requires either direct or very close proximity of the reading head to the object and can be easily tampered with by use of a hard magnet. Furthermore, magnetic stripes cannot serve as a remotely sensed antitheft device.

There is a widespread problem with theft in many industries, e.g., in the computer industry where there is theft of both computer parts and components and entire computers. The theft is difficult to detect and if recovered after the theft, the recovered items are difficult if not impossible to identify. Thus, what is needed in addition to an anti-theft device is a means to identify the owner along with important data such as the warranty date. It is therefore important to 1) provide a means for preventing theft by concealing a type of sensor that can sound an alarm to an externally located receiver and 2) provide a set of elements that yield a code upon local interrogation, the elements being concealed and personalized to permit identification of the object should it be stolen and recovered.

SUMMARY OF THE INVENTION

An object of this invention is to provide means for providing antitheft alarms as well as codes to be concealed within any item that might require identification. In particular, the code is concealed so that upon theft and recovery of the stolen item, the authorities can read the hidden code to determine the identity of the rightful owner whereupon the item can be returned appropriately. Also, alone or in combination with the identity code, a code which verifies the authenticity (manufacturer, for example) of the object can be provided.

Concealment has the intended purpose of making it difficult to destroy the identifying code since, for example, a typical optically scanned bar code can be easily removed because it is not concealed. However, with concealment, the thief will not be able to destroy the code readily. In certain smaller items, where the code can only occupy a very limited region, destroying the code will also destroy the item. This is particularly true for concealment in electronic and computer components, one of the main directions toward which this invention is focused. Other items can also be protected and recovered using the invention to be described including such diverse items as automobiles and critical automobile parts to mention but a few.

Several means for providing and detecting a buried pattern that can be sensed and interpreted to give an identification code are provided by the present invention. The pattern is buried for the sake of concealment in a manner that makes it difficult for unauthorized persons to read, tamper with or alter the code. An important application, though not an exclusive one, pertains to concealing these patterns in computer boards, single in-line memory modules (SIMMs), computer chips and the like. In addition, the invention includes the use of an antitheft element designed to reduce theft of the item by triggering an alarm when the item is taken past a security gate. This element is also concealed near the concealed code region or may be made an integral part of the aforementioned concealed code. One embodiment utilizes infrared radiation to read the code. Yet another embodiment makes use of acoustic reflected or emitted waves from the elements forming the code to obtain an acoustic signal from which the code can be interpreted. Another embodiment uses magnetic imaging of fringing fields resulting from magnetic excitation of a given concealed array. An additional means consists of using fluorescent compounds that can be configured in an array provide a code in the form of spots or lines, the code read by illuminating the fluorescent compound with radiation at a frequency differing from that frequency at which the main fluorescence arises.

BRIEF DESCRIPTION OF THE DRAWINGS

The above and other advantages of this invention will become more apparent from the following description taken in conjunction with the accompanying drawings, in which.

DETAILED DESCRIPTION OF THE INVENTION

Figure 1:
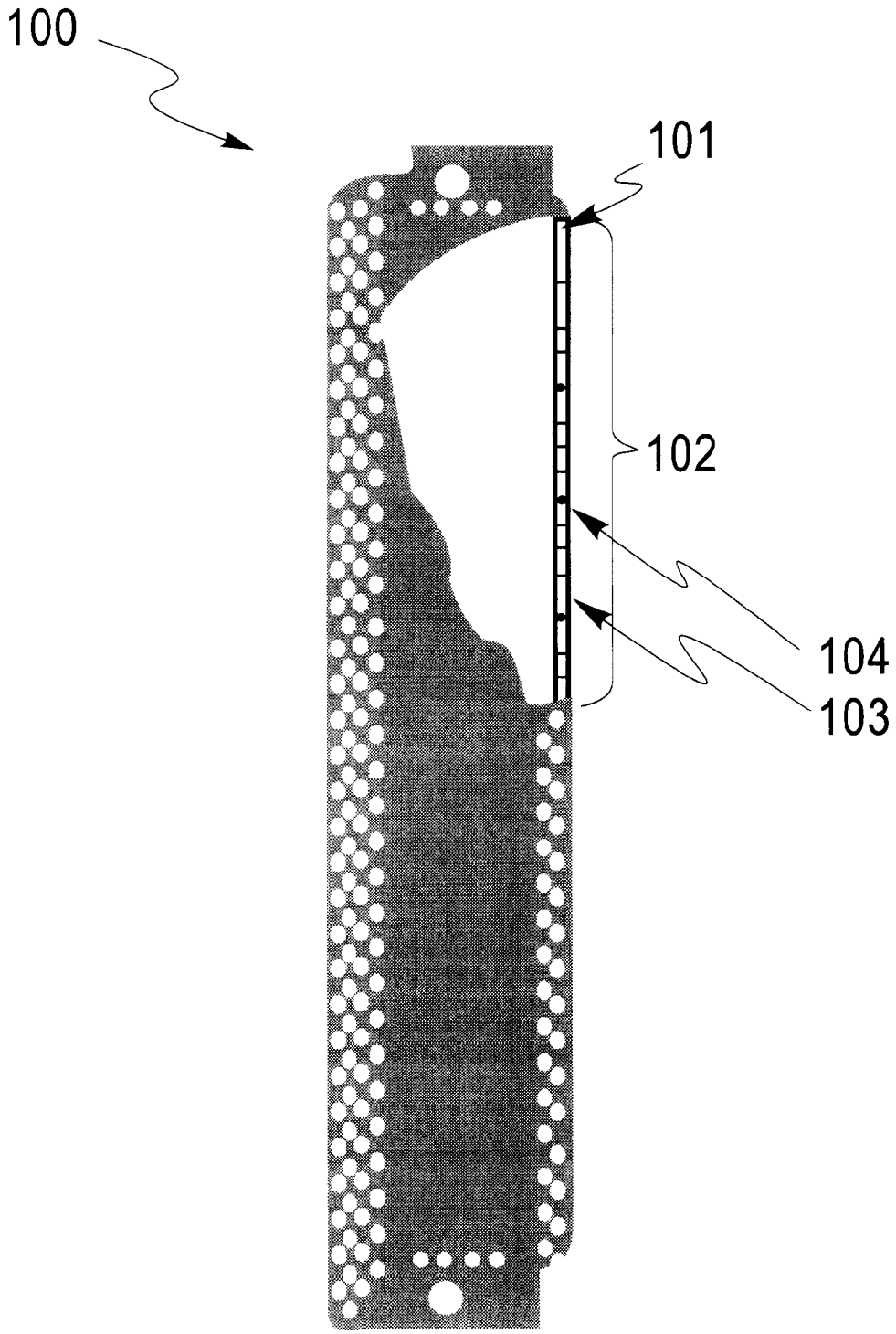
FIG. 1 is a schematic of a SIMM which has embedded therein an array that forms a code in addition to a magnetic wire that functions as an antitheft device.

FIG. 1 is an example of an antitheft device 101 embedded in a single in-line memory module (SIMM) 100 in conjunction with an array 102 comprising a set of two different elements (103, 104) that can be used to provide identification of the item to which it is attached. Antitheft element 101 is in the form of a wire or strip of soft magnetic material that yields a magnetic induction rich in harmonics when interrogated with a single frequency ac magnetic field. The elements of array 102 are composed of high thermal conductivity material such as copper, nickel or sputtered diamond-like carbon. Array elements 102 lie in intimate thermal contact with wire 101. This concealed arrangement, when appropriately interrogated with a source of heat or sound can be detected by infrared or acoustic methods.

Figure 2A:
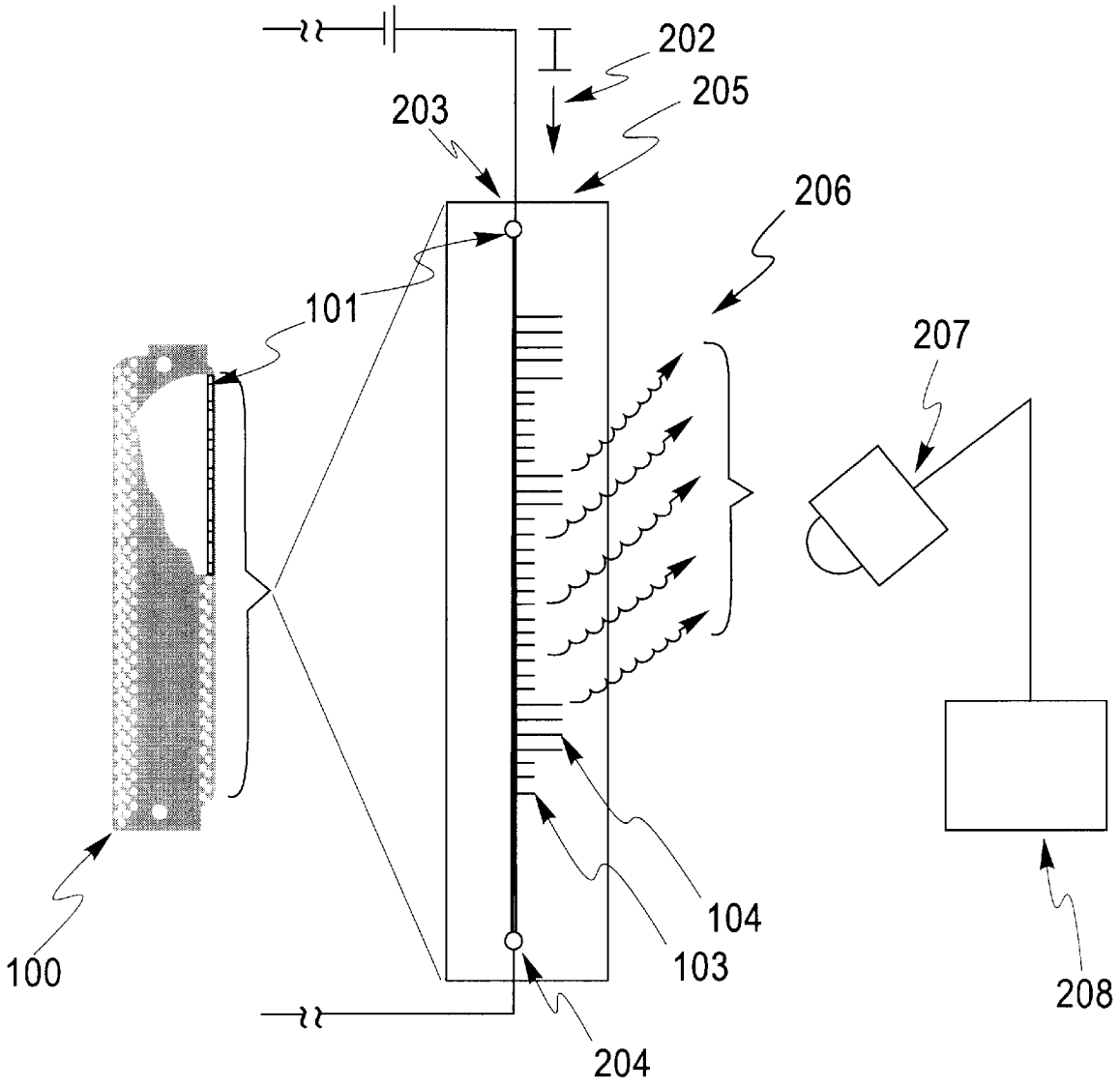
FIG. 2A shows an embodiment of the invention comprising an antitheft wire through which a current passes to provide heat to a concealed array by thermal conduction in order to radiate a code in the form of an infrared emission spectrum.

An embodiment in which antitheft wire 101 is also used as a source of heat in order to produce an infrared emission spectrum from array 102 is shown in FIG. 2A embedded in SIMM 100. The elements of array 102, which are of high thermal conductivity, are in intimate contact with wire 101. When a dc or ac current 202 is passed through wire 101 via electrical contact points 203, 204, the temperature of the wire will rise due to resistive dissipation or joule heating. Due to the intimate contact between array 102 and wire 101 and because of the much greater heat conductivity of array elements 102 relative to medium 205 in which they are embedded, array elements 103, 104 will increase in temperature above ambient giving rise to infrared emission spectrum 206. Under these conditions, provided that medium 205 is sufficiently transparent to infrared light, the array pattern can be detected by means of infrared camera 207; for example, a charge coupled device (CCD) or other similar infrared detector situated approximately at right angles to the plane of FIG. 2A.

Figure 2B:
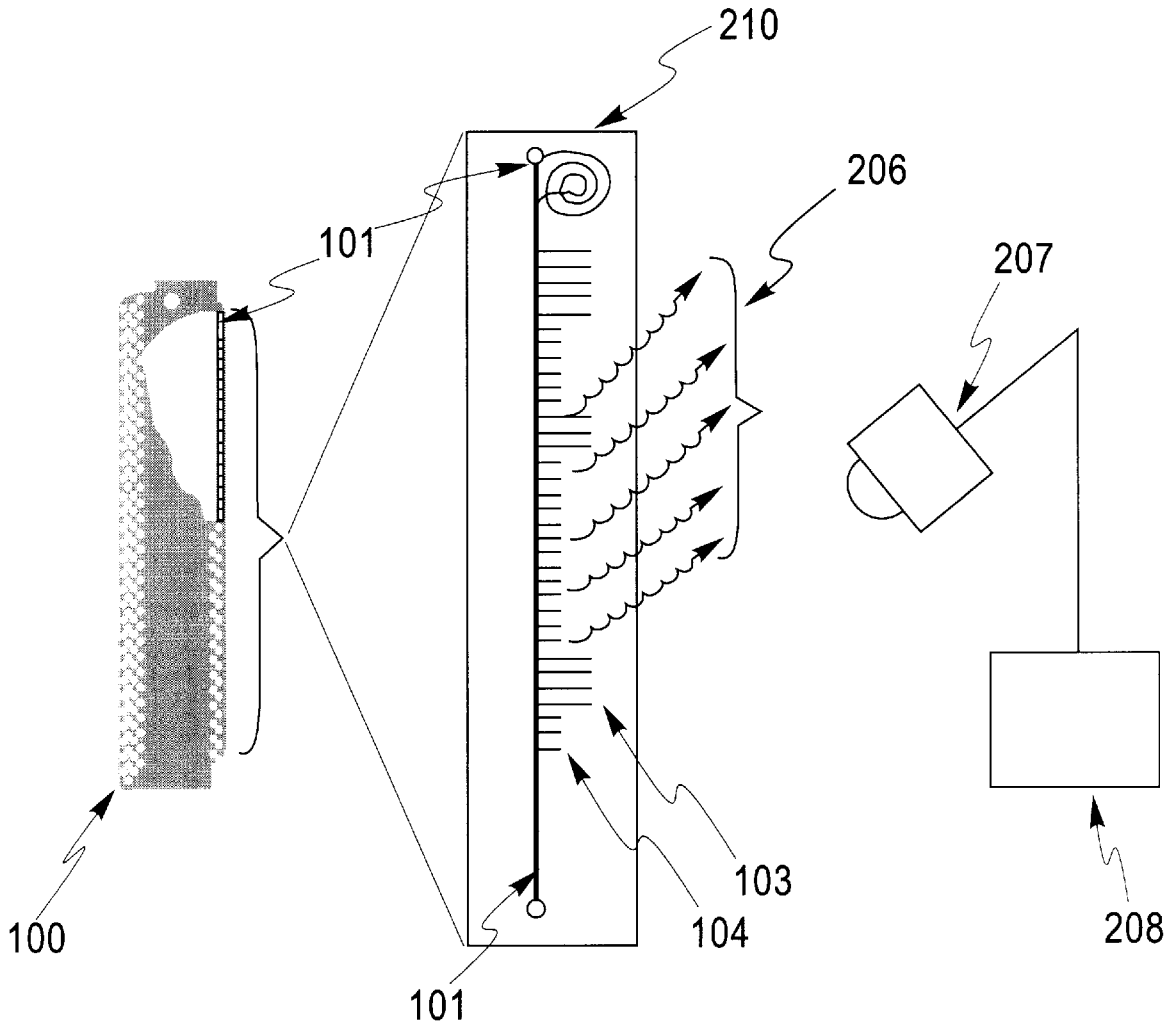
FIG. 2B shows an alternative embodiment to that of FIG. 2A wherein the heating is by induction heating means.

The detected spectrum can be interpreted by computer 208 to give specific identification information based on a preestablished code. For example, short elements 103 can be interpreted by computer 208 to correspond to "0s" and long elements 104 to correspond to "1s", thus forming a code. Alternatively, a pattern of elements 104 with spaces in lieu of elements 103 can also be used to form the code. This allows for efficient reading of the tag at angles in or close to being in the plane of FIG. 2B. FIG. 2B shows the use of embedded induction coil 210, which is electrically connected to the ends (203, 204) of wire 101, to heat wire 101 and hence elements 103 and 104.

Figure 3A:
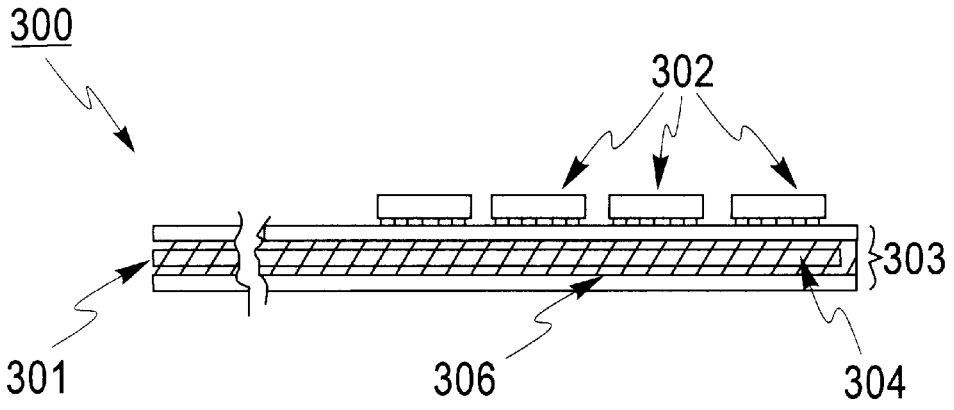
FIG. 3A shows an edge view of an embodiment comprising an embedded coated wire wherein the coating is locally modified to have varying local emissivities thereby establishing a code.

FIG. 3A is a side view of a SIMM 300 containing the memory elements 302 and soft magnetic wire 301 embedded in edge 303 of SIMM board 300. Wire 301 is coated with insulating coating 304 having a known emissivity. The coated wire is attached to SIMM board 300 by an optically transparent overcoat 306 such as epoxy.

Figure 3B:
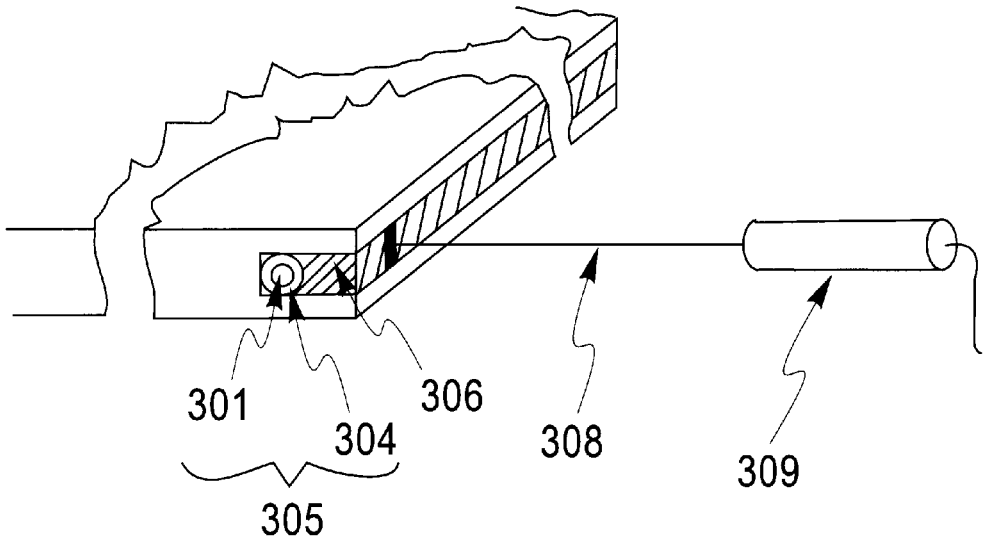
FIG. 3B is a schematic perspective of the embodiment of FIG. 3A showing a means for establishing the code.
Figure 3C:
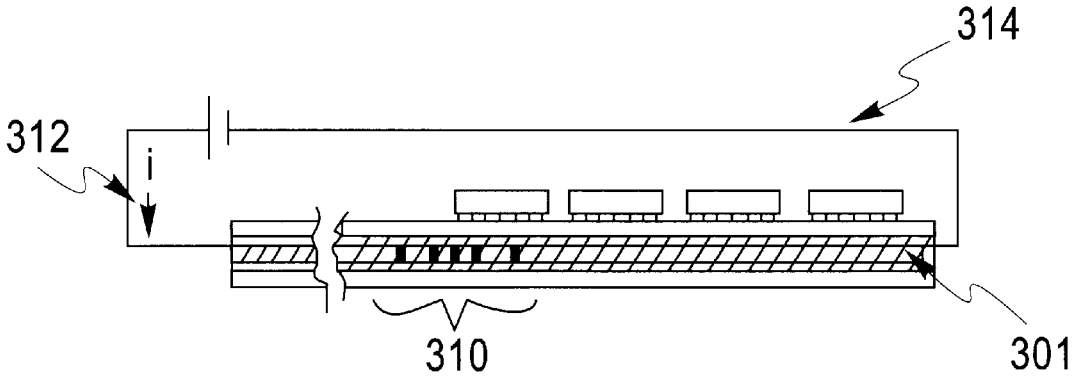
FIG. 3C shows the embodiment of FIG. 3A including means to enable infrared emission of the code of FIG. 3B.

FIG. 3B shows schematically an embodiment for writing a code on coating 304 after it is applied to wire 301 and after coated wire 305 is embedded in board 300. Typical materials for overcoat 306 are, for example, clear epoxies, silicon dioxide, and various glues. On the other hand, coating 304 on wire 301 is relatively optically absorbing so that it can be modified by pulses of laser light 308 of sufficient intensity emanating from focused laser 309 to form an array of regions of varying emissivities. The patterned regions of varying emissivity form a code 310 as shown in FIG. 3C. The code at 310 can be interpreted as 1, 0, 1, 1, 1, 0, 1 based on the spacing of the emitting regions. Such a code may be structured to give several types of information, such as manufacturer, part number and serial number. An item not having all of the parts of the code, e.g., manufacturer, may be identified as being counterfeit. The required optics and accompanying hardware to automate this type of personalization of coated wire 305 are well known in the art.

FIG. 3C also shows an embodiment which enables reading of code 310. Here, electrical current 312 provided by external circuit 314 connected to the ends of wire 301 produces joule heating. As a result of the uniform heating of wire 301, the regions of overcoat 304 that have been modified by laser 309 will radiate at a different intensity compared to those that have not been laser irradiated.

Figure 3D:
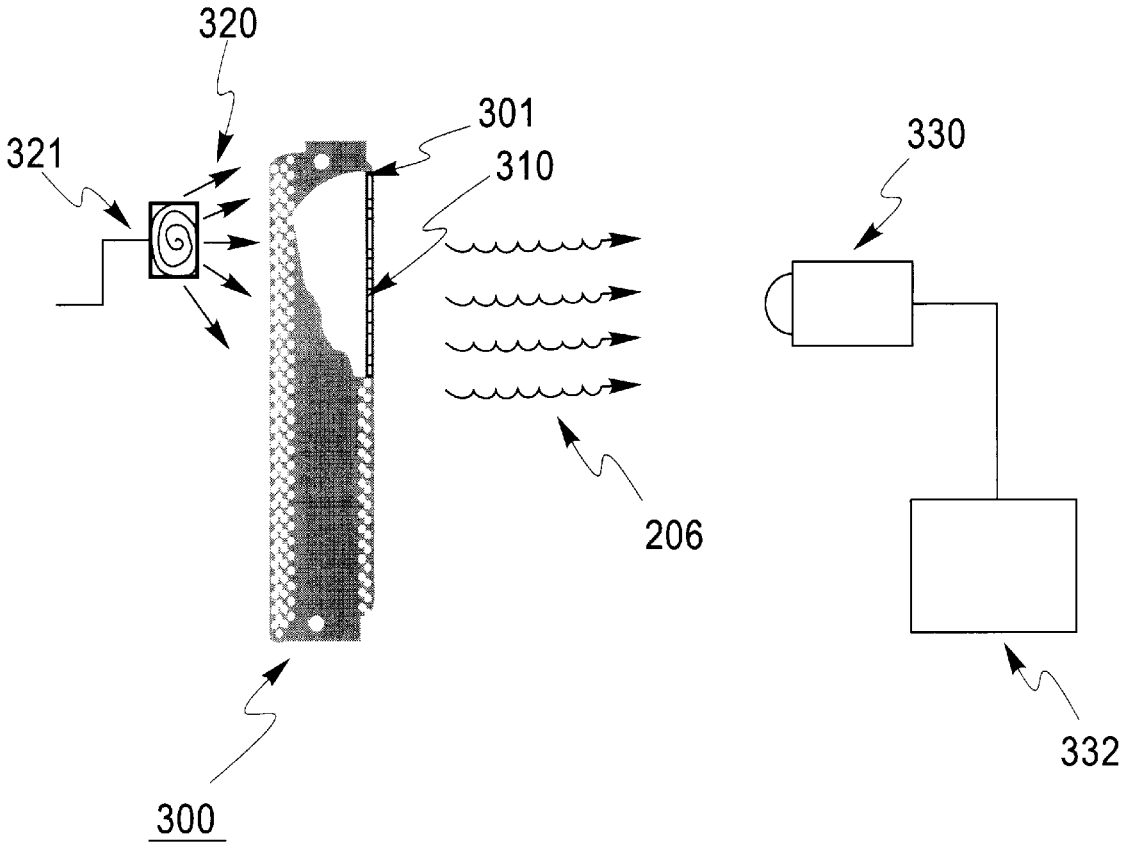
FIG. 3D shows alternative means to those of FIG. 3C for coupling RF energy into the antitheft wire to enable infrared emission of the code of FIG. 3B.

FIG. 3D shows an embodiment in which the temperature of wire 301 is raised by induction heating using an RF field 320 provided by induction head 321. Because of the magnetic properties of wire 301, a magnetic field of appropriate field strength and frequency can be chosen so that the energy transfer occurs mainly to the wire 301 which in turn heats coating 304 while the temperature of board 300 and overcoat 306 remains relatively unaffected.

Figure 4A:
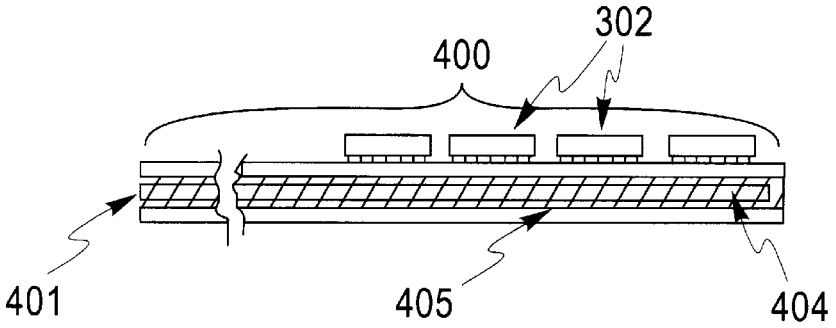
FIG. 4A shows an edge view of an embodiment comprising an embedded wire coated with a fluorescent material for the purpose of establishing a code.

In the embodiment shown in FIG. 4A, magnetic wire 401 is embedded in a side of SIMM board 400. Wire 401 is coated with insulating material 404 containing one or more fluorescent materials such as one or more of many well known fluorescing dyes, e.g. rhodamine 6G, sodium fluorescein, 7-diethylamino-4-methylcoumarin. The dyes are easily incorporated in a variety of insulating carrier materials such as water based adhesives, epoxies, alcohol and acetone based adhesives to form a hardened coating after drying. Additional carrier materials, well known in the field of dye laser technology, include polymethylmethacralate (PMMA) and polyurethane, both of which exist in both liquid and solid form as well as certain sol gels. The carrier material, after hardening, must also have the property that it does not appreciably affect the fluorescent capability of the dye, that is its quantum efficiency. In addition, upon hardening the carrier mixed with the dye should preferably be electrically insulating with the fluorescence capable of being excited preferably by near uv radiation.

Figure 4B:
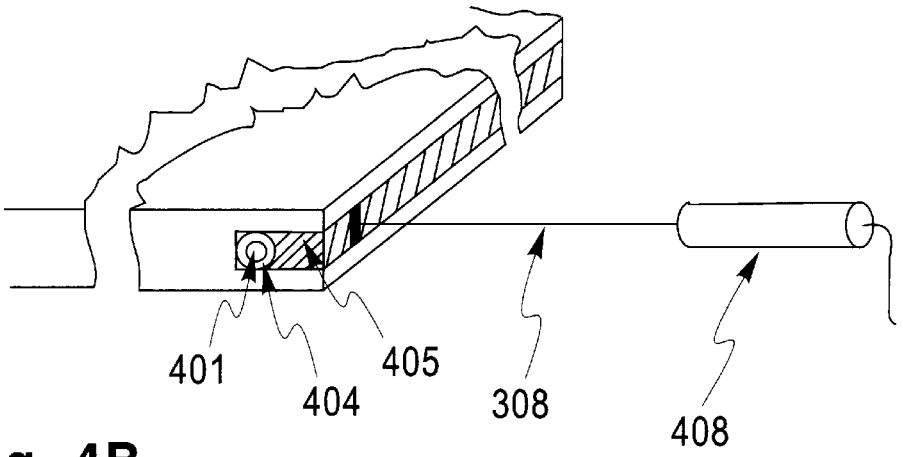
FIG. 4B is a perspective schematic of the embodiment of FIG. 4A which shows laser means for encoding the fluorescent material of FIG. 4A.
Figure 4C:
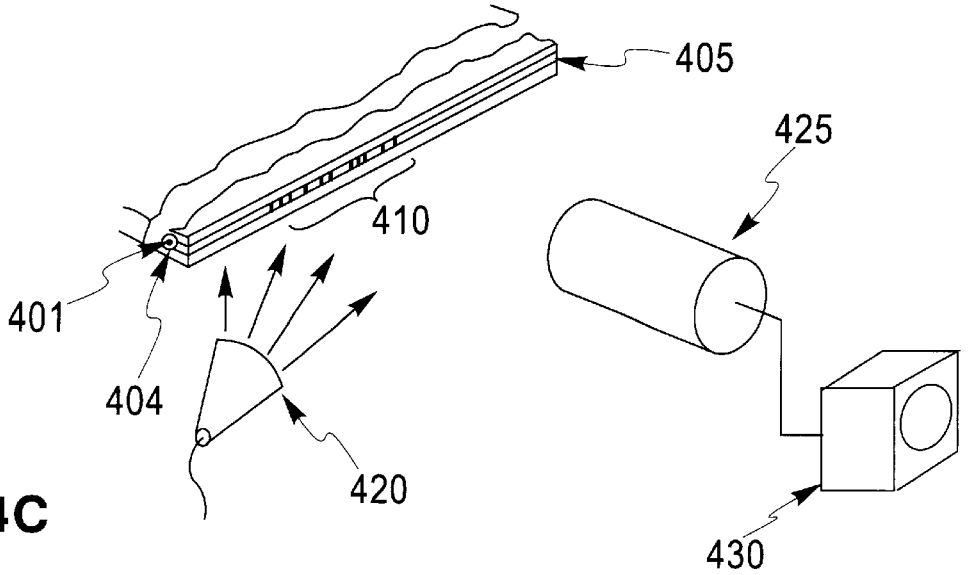
FIG. 4C shows a method of reading the fluorescent code of the embodiment of FIG. 4B using an ultraviolet light as the source of excitation.

After coating 404 has dried, the area containing the fluorescent material can be coded (patterned) by any one of a number of techniques, preferably focused laser 408, to darken, ablate or permanently bleach regions along fluorescent material 404. This coding can take place immediately after applying the fluorescent material to the wire or after the fluorescent material is overcoated with a protective layer 405 as shown in FIG. 4B. Another method of coding is to use a laser to darken or ablate a layer of protective overcoating 405 thereby also establishing contrast between fluorescing and non-fluorescing regions. The coding is produced in such a manner that it is not readily discerned using visible light. Rather, in a preferred embodiment, code array 410 is discernible using ultraviolet light from lamp 420 or other hand held 'black light' source as shown in FIG. 4C. Code 410, when illuminated by uv source 420 can be imaged by any one of a number of techniques, such as optical microscopy, in combination with video camera 425. Code 410 can be interpreted by scanning or imaging using an interface to computer 430. Alternatively, a photograph of fluorescing code 410 can be taken to form a permanent record which can be interpreted using a scanner, for example a bar code scanner.

Figure 5:
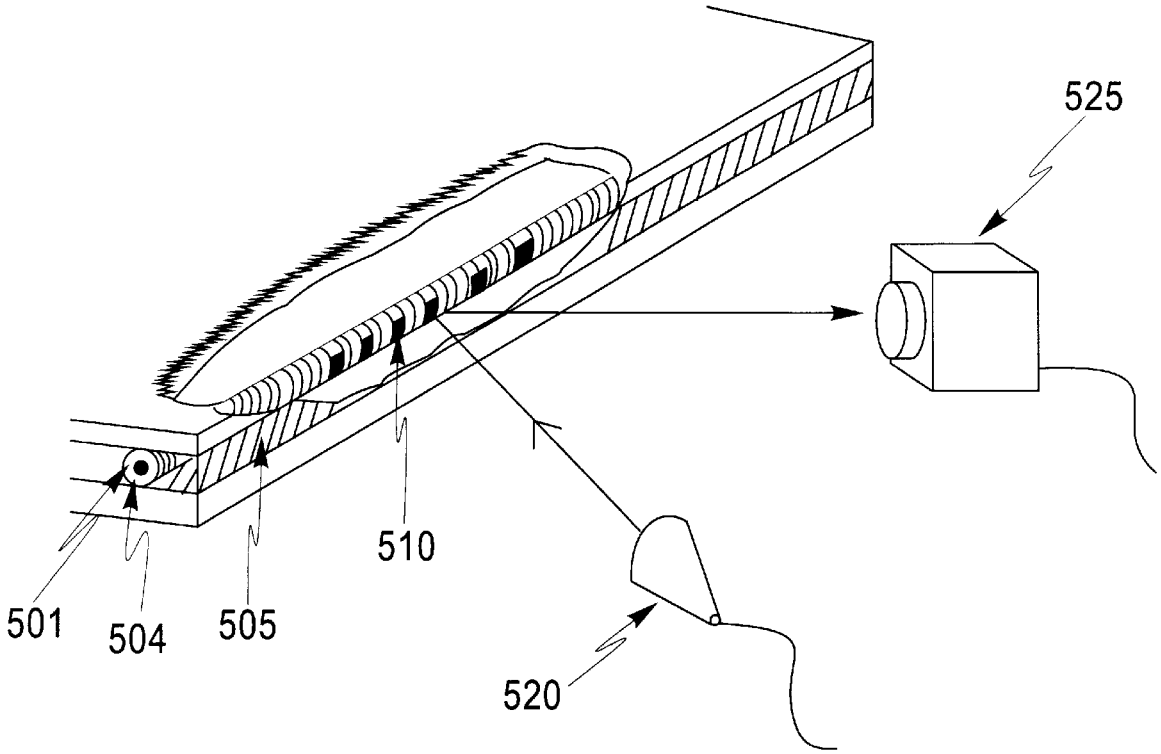
FIG. 5 is a perspective cross-section of an embodiment wherein alternative means to those of FIG. 4B are used to form the code.

In yet another embodiment shown in FIG. 5, coating 504 need not be fluorescent. Instead, it can be made of a material capable of undergoing a change in local reflectivity upon local heating at the interface between wire 501 and wire coating 504 or, alternatively, between the wire coating 504 and transparent overcoat 505. This local change in reflectivity can be used to form code 510 that can be sensed with white light from lamp 520 and pattern 510 registered by video camera 525. Code 510 can be made by focussing a laser beam at the wire/coating interface, as in FIG. 4B, to cause local bubble formation, charring or deformation due to the intense localized heat caused by the absorption of the laser light.

Figure 6A:
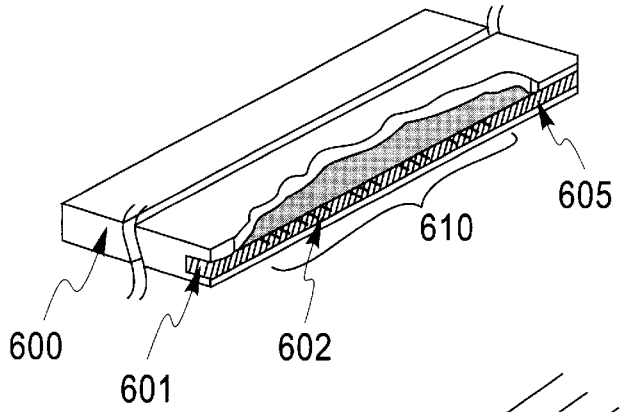
FIG. 6A shows another embodiment in perspective cross-section of a concealed magnetic array comprising an antitheft wire and a code formed by magnetic elements.

In yet another embodiment, soft magnetic wire or strip 601, as shown in FIG. 6A, embedded in board 600, can be used in conjunction with small sections of magnetic elements 602 to form array 610 similar to that of a bar code, resting on top of wire 601. Wire 601 and additional elements 602 may be concealed in circuit board 600 or other computer component by overcoat 605. The small segments 602 of array 610 may be fabricated using magnetic ink or a composite of ferromagnetic particles of high coercivity and, therefore, printed with specified personalization to provide a code that is unique to each item. Examples of such high coercive magnetic materials are particles of barium hexaferrite or iron.

Wire 601 has two functions. First, it serves as an antitheft device when interrogated by an ac field as previously described and, second, it serves as means to provide a code. For the second function, wire 601 acts as a source of magnetic field that allows reading of the magnetic code established by the magnetic elements 602 mounted in close proximity to or on wire or magnetic strip 601, which are concealed by overcoat 605.

Figure 6B:
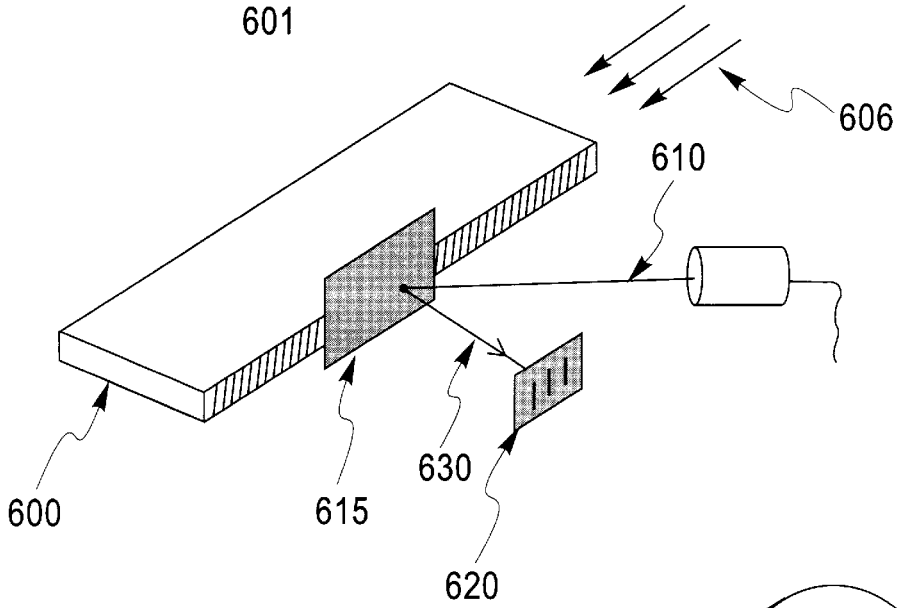
FIG. 6B shows in perspective cross-section a method for reading the code of FIG. 6A that employs ac magnetic interrogation in conjunction with a rare earth iron garnet as a magneto optic transducer.

Reading of code 610 can be accomplished by placing sheet 615 of an iron garnet, preferably a rare earth iron garnet, over the region of the buried code 610 and exciting wire or strip 601 by means of an externally applied ac field 606, typically of low intensity, e.g. 0.5 oersted, as shown in FIG. 6B. In general, a perpendicular component of the field is produced about the length of the wire as a function of position and time by the change in orientation of the core domains of the wire upon application of the ac field. These fields will cause a time dependent perturbation of the domain pattern of the garnet 615 which can be imaged in garnet sheet 615 using the magneto-optic Faraday or Kerr effect in conjunction with stroboscopic polarized light 610 and polarizing filters 620, where the stroboscopic frequency is integrally related to the ac field frequency. The presence of magnetic array 610 will create a contrast in the intensity of reflected polarized light 630 due to the local change in the perpendicular component of the local field of the wire introduced by the presence of each element 602 of array 610. The magneto optic image of array 610 can be made to resemble the pattern of a conventional bar code which can be interpreted in the usual manner to supply the identification of the article.

Figure 6C:
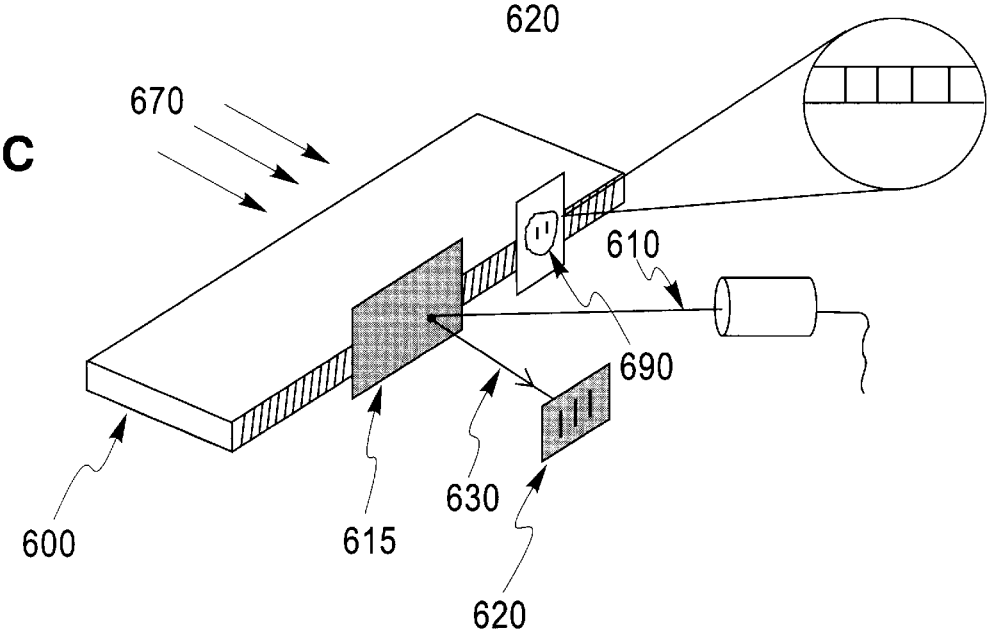
FIG. 6C shows other means to those of FIG. 6B for reading the code.

Another embodiment, that of FIG. 6C, permits imaging of the magnetic pattern of wire 601 in sheet 615 using dc field 670 so that the different elements 602 of magnetic array 610 causes a difference in the local field of sheet 615. Again, this variation in field can constitute a code which can be interpreted in the manner described above in conjunction with FIG. 6B.

In another embodiment using a dc field, a ferrofluid or a material containing particles capable of producing magnetic decorations 690, that is a higher concentration of particles around regions of a relatively high density of magnetic lies of flux, can be used to image the embedded magnetic code in place of sheet 615.

Alternatively the code need not be made of magnetic elements but of non-magnetic metal to modify the field pattern produced by the wire.

Figure 7:
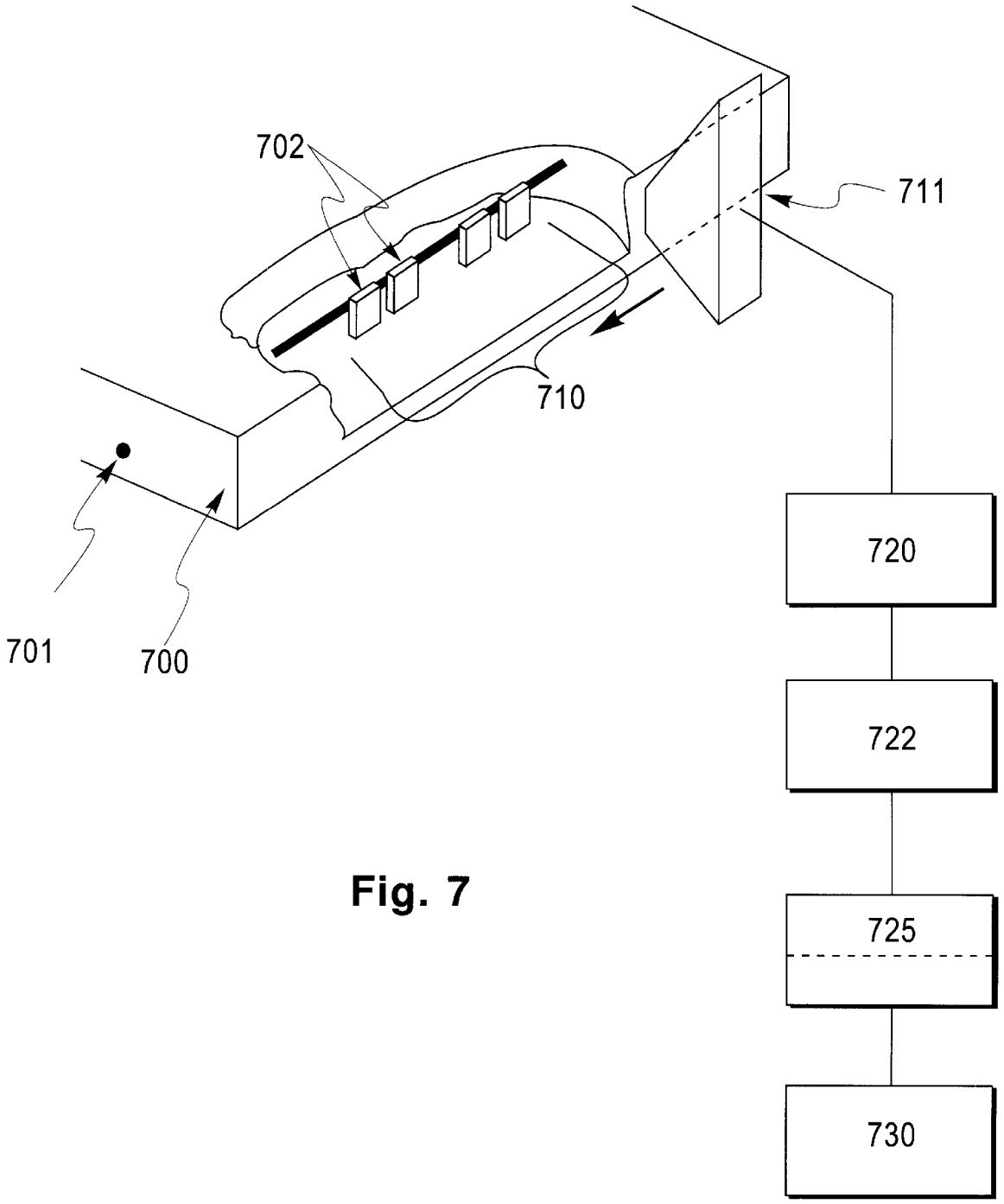
FIG. 7 shows a schematic of an embodiment in which an acoustic transducer is used in the send-receive mode to interrogate a buried pattern in the form of a code.

An acoustic field can also be used to image an embedded array and a magnetic wire as shown in FIG. 7 for array 710 of elements 702 and wire 701. Array 710 is an array of segments of a metal, such as copper, which produce an acoustic mismatch between the metal and the material in which it is embedded which can be interrogated by high frequency acoustic transducer 711. Transducer 711 is designed to have a very narrow surface area contacting board 700. Segments 702 are selected such that the incident acoustic waves produce an echo pattern that varies as a function of position along the array. Small, smooth surfaced, flat pieces whose length and width are approximately equal and are large compared to the wavelength of the incident acoustic waves in the embedding medium are preferred. Also, the preferred thickness is ¼ of the wavelength of the incident acoustic wave inside metallic elements 702. Transducer 711 is driven by transceiver 720 that sends out electrical pulses, preferably in the MHz range. Transceiver 720 is connected to interface 722 that encodes the received signals as transducer 711 is scanned across board 700 so that a b-scan, which is an echo pattern as a function of position, is imaged on video monitor 725. For example, transducer 711 can be tapered to have a shape similar to a narrow nozzle as shown in FIG. 7. The acoustic waves emanating from transducer 711 are coupled into board 700 and will be partially reflected by buried array 710. The strength of the reflected wave is a direct measure of the pattern which can be detected by the same transducer to produce a b-scan image, thereby providing an image of concealed elements 702 of array 710. The code can be directly interpreted by computer 730. Alternatively, the b-scan pattern can be printed and read by a standard scanner. In general, the stronger echo corresponds to the presence of an element, i.e., a "1", and the weaker (or absence of an echo) corresponds to a "0".

In the embodiment shown in FIG. 6B, wire 601 must be of a soft magnetic material capable of exhibiting core domain switching. In the embodiment of FIG. 7, wire 701 is optional. In the other embodiments described, the wires need not be of a soft magnetic material, unless the antitheft capability is desired, and need only be metallic to provide enablement or enhancement (as in FIG. 4 for enhanced reflectivity in the UV embodiment) of the code. In the latter such cases, reference to magnetic antitheft elements shall also be construed to include a non-magnetic, but metallic, wire or strip.

While this invention has been described in terms of preferred and alternate embodiments, those skilled in the art will appreciate that many modifications may be made without departing from the spirit and scope of the invention. Accordingly, all such modifications are intended to be included within the scope of the claims appended hereto.

We claim:

1. A tag for concealing in an object for providing antitheft protection and identification comprising:

a magnetic antitheft element; and an identification code comprising a pattern of first and second segments of wires of high thermal conductivity situated at right angles to said antitheft element and in intimate thermal contact with said antitheft element, wherein the length of said first segments is longer than the length of said second segments.

2. The tag of claim 1 wherein said antitheft element comprises an amorphous wire.

3. The tag of claim 1 wherein said antitheft element comprises an amorphous strip.

4. The tag of claim 1 wherein the material of said segments is one selected from the group consisting of copper, nickel or sputtered diamond-like carbon.

5. A tag for concealing in an object for providing antitheft protection and identification comprising:

a magnetic antitheft element; and an identification code comprising a pattern of spaces and segments of wires of high thermal conductivity situated at right angles to said antitheft element and in intimate thermal contact with said antitheft element.

6. The tag of claim 5 wherein said antitheft element comprises an amorphous wire.

7. The tag of claim 5 wherein said antitheft element comprises an amorphous strip.

8. The tag of claim 5 wherein the material of said segments is one selected from the group consisting of copper, nickel or sputtered diamond-like carbon.

9. A tag for concealing in an object for providing antitheft protection and identification comprising:

a magnetic antitheft element; and an identification code comprising a pattern of spaces and segments of magnetic wires situated at right angles to said antitheft element and magnetically coupled to said antitheft element.

10. A system for protecting an object from theft and for identifying said object comprising:

a magnetic antitheft element;

an identification code comprising a pattern of first and second segments of wires of high thermal conductivity situated at right angles to said antitheft element and in intimate thermal contact with said antitheft element, wherein the length of said first segments is longer than the length of said second segments; and means for reading said code, said reading means comprising means for heating said antitheft element and said segments and means for detecting the infrared emission spectrum emitted from said segments.

11. A system as in claim 10 wherein said means for heating includes means for passing an electrical current through said antitheft element.

12. A system as in claim 10 wherein said means for heating includes inductive means for passing through said antitheft element.

13. The system of claim 10 wherein said antitheft element comprises an amorphous wire.

14. The system of claim 10 wherein said antitheft element comprises an amorphous strip.

15. The system of claim 10 wherein the material of said segments is one selected from the group consisting of copper, nickel and sputtered diamond-like carbon.

16. A system for protecting an object from theft and for identifying said object comprising:

a magnetic antitheft element;

an identification code comprising a pattern of spaces and segments of wires of high thermal conductivity situated at right angles to said antitheft element and in intimate thermal contact with said antitheft element; and means for reading said code, said reading means comprising means for heating said antitheft element and said segments and means for detecting the infrared emission spectrum emitted from said segments.

17. The system of claim 16 wherein said antitheft element comprises an amorphous wire.

18. The system of claim 16 wherein said antitheft element comprises an amorphous strip.

19. The system of claim 16 wherein the material of said segments is one selected from the group consisting of copper, nickel and sputtered diamond-like carbon.

20. A system for protecting an object from theft and for identifying said object comprising:

a magnetic antitheft element;

an identification code comprising a pattern of spaces and segments of magnetic wires situated at right angles to said antitheft element and magnetically coupled to said antitheft element; and means for reading said code.

21. A tag for concealing in an object for providing identification comprising:

a metallic element; and an identification code comprising a pattern of first and second segments of wires of high thermal conductivity situated at right angles to said metallic element and in intimate thermal contact with said metallic element, wherein the length of said first segments is longer than the length of said second segments.

22. The tag of claim 21 wherein said metallic element is an antitheft element.

23. The tag of claim 22 wherein said antitheft element comprises an amorphous wire.

24. The tag of claim 22 wherein said antitheft element comprises an amorphous strip.

25. The tag of claim 21 wherein the material of said segments is one selected from the group consisting of copper, nickel or sputtered diamond-like carbon.

26. A tag for concealing in an object for providing identification comprising an identification code comprising a pattern of segments of a metal, said segments being capable of preferentially reflecting an incident acoustic wave the reflections of which are capable of being detected acoustically and from which said code can be interpreted.

27. The tag of claim 26 further including a magnetic antitheft element in close proximity to said segments.

28. The tag of claim 27 wherein said antitheft element comprises an amorphous wire.

29. The tag of claim 27 wherein said antitheft element comprises an amorphous strip.

30. A tag for concealing in an object for providing antitheft protection and identification comprising:

a magnetic antitheft element; and a pattern of segments of a metal, said segments being capable of preferentially reflecting an incident acoustic wave the reflections of which are capable of being detected acoustically and from which said code can be interpreted.

31. The tag of claim 30 wherein said antitheft element comprises an amorphous wire.

32. The tag of claim 30 wherein said antitheft element comprises an amorphous strip.

33. A system for protecting an object from theft and for identifying said object comprising:

a magnetic antitheft element;

a pattern of segments of a metal, said segments being capable of preferentially reflecting an incident acoustic wave the reflections of which are capable of being detected acoustically and from which said code can be read and interpreted; and means for reading said code.

* * * * *